US006098458A

United States Patent [19]

French et al.

[11] Patent Number: 6,098,458

[45] Date of Patent: Aug. 8, 2000

[54] TESTING AND TRAINING SYSTEM FOR ASSESSING MOVEMENT AND AGILITY SKILLS WITHOUT A CONFINING FIELD

[75] Inventors: Barry James French, Bay Village; Kevin R. Ferguson, Sagamore Hills, both of Ohio

[73] Assignee: Impulse Technology, Ltd., Westlake, Ohio

[21] Appl. No.: 08/554,564

[22] Filed: Nov. 6, 1995

[51] Int. Cl.[7] ..... A61B 5/22

[52] U.S. Cl. ..... 73/379.04

[58] Field of Search ..... 73/65.01, 172, 73/379.04

[56] References Cited

U.S. PATENT DOCUMENTS

| | | |
|---|---|---|
| 4,751,642 | 6/1988 | Silva et al. . |
| 4,817,950 | 4/1989 | Goo . |
| 5,148,154 | 9/1992 | MacKay et al. . |
| 5,229,756 | 7/1993 | Kosugi et al. . |
| 5,320,538 | 6/1994 | Baum . |
| 5,347,306 | 9/1994 | Nitta . |
| 5,385,519 | 1/1995 | Hsu et al. . |
| 5,495,576 | 2/1996 | Ritchey . |
| 5,524,637 | 6/1996 | Erickson . |
| 5,580,249 | 12/1996 | Jacobsen et al. . |
| 5,597,309 | 1/1997 | Riess . |

OTHER PUBLICATIONS

Virtual Environment Display System, Fisher et al., 1986.

Virtual Reality Check, Technology Review, vol. 96, No. 7, Sheridan et al., 1993.

Flights Into Virtual Reality Treating Real World Disorders; Science.

Virtual High Anxiety; Tech Update.

*Primary Examiner*—Elizabeth L. Dougherty
*Attorney, Agent, or Firm*—Cherskov and Flaynik

[57] ABSTRACT

A movement skills assessment system without a confining field includes a wireless position tracker coupled to a personal computer and viewing monitor for the purpose of quantifying the ability of a player to move over sport specific distances and directions. The monitor displays a computer-generated virtual space which is a graphic representation of a defined physical space in which the player moves and the current position of the player. Interactive software displays a target destination distinct from the current position of the player. The player moves as rapidly as possible to the target destination. As the movement sequence is repeated, velocity vectors are measured for each movement leg, allowing a comparison of transit speeds in all directions as well as measurement of elapsed times or composite speeds. The system has applications in sports, commercial fitness and medical rehabilitation.

9 Claims, 7 Drawing Sheets

TESTING AND TRAINING SYSTEM FOR ASSESSING MOVEMENT AND AGILITY SKILLS WITHOUT A CONFINING FIELD

FIELD OF THE INVENTION

The present invention relates to a system for assessing movement and agility skills and, in particular to a wireless position tracker for continuously tracking and determining player position during movement in a defined physical space through player interaction with tasks displayed in a computer generated, spacially translated virtual space for the quantification of the player's movement and agility skills based on time and distance traveled in the defined physical space.

BACKGROUND OF THE INVENTION

Various instruments and systems have been proposed for assessing a person's ability to move rapidly in one direction in response to either planned or random visual or audio cuing. One such system is disclosed in French et. al. U.S. Ser. No. 07/984,337 , filed on Dec. 2, 1992, entitled "Interactive Video Testing and Training System," and assigned to the assignee of the present invention. Therein, a floor is provided with a plurality of discretely positioned force measuring platforms. A computer controlled video monitor displays a replica of the floor and audibly and visually prompts the user to move between platforms in a pseudo-random manner. The system assesses various performance parameters related to the user's movements by measuring critical changes in loading associated with reaction time, transit time, stability time and others. At the end of the protocol, the user is provided with information related to weight-bearing capabilities including a bilateral comparison of left-right, forward-backward movement skills. Such a system provides valuable insight into user's movement abilities in a motivating, interactive environment.

Sensing islands or intercept positions in the form of digital switches or analog sensors that respond to hand or foot contact when the player arrives at a designated location have been proposed for providing a variety of movement paths for the user as disclosed in U.S. Pat. No. 4,627,620 to Yang. The measurement of transit speeds has also been proposed using discrete optical light paths which are broken at the designated locations as disclosed in U.S. Pat. No. 4,645,458 to Williams. However the inability to track the player's movement path continuously inhibits the development of truly interactive games and simulations. In these configurations, the actual position of the player between positions is unknown inasmuch as only the start and finish positions are determined. Most importantly, the requirement that the player move to designated locations is artificial and detracts from actual game simulation in that an athlete rarely undertakes such action, rather the athlete moves to a visually determined interception path for the particular sports purpose.

For valid testing of sports specific skills, many experts consider that, in addition to unplanned cuing, it is important that the distances and directions traveled by the player be representative of actual game play. It is thus desirable to have the capability to measure transit speeds over varying vector distances and directions such that the results can be of significant value to the coach, athletic trainer, athlete and clinician. It is also important to detect bilateral asymmetries in movement and agility so as to enable a clinician or coach to develop and assess the value of remedial training or rehabilitation programs. For example, a rehabilitating tennis player may move less effectively to the right than to the left due to a left knee injury, i.e. the "push off" leg. A quantitative awareness of this deficiency would assist the player in developing compensating playing strategies, as well as the clinician in developing an effective rehabilitation program.

In actual competition, a player does not move to a fixed location, rather the player moves to an intercept position determined visually for the purpose of either contacting a ball, making a tackle or like athletic movement. Under such conditions, it will be appreciated that there are numerous intercept or avoidance paths available to the player. For example, a faster athlete can oftentimes undertake a more aggressive path whereas a slower athlete will take a more conservative route requiring a balancing of time and direction to make the interception. Successful athletes learn, based on experience, to select the optimum movement paths based on their speed, the speed of the object to be intercepted and its path of movement. Selecting the optimum movement path to intercept or avoid is critical to success in many sports, such as a shortstop in baseball fielding a ground ball, a tennis player returning a volley, or ball carrier avoiding a tackler.

None of the foregoing approaches spatially represents the instantaneous position of the player trying to intercept or avoid a target. One system for displaying the player in a game simulation is afforded in the Mandela Virtual World System available from The Vivid Group of Toronto, Ontario, Canada. One simulation is hockey related wherein the player is displayed on a monitor superimposed over an image of a professional hockey net using a technique called chroma-keying of the type used by television weather reporters. Live action players appear on the screen and take shots at the goal which the player seeks to block. The assessment provided by the system is merely an assessment of success, either the shot is blocked or, if missed, a goal is scored. This system uses a single camera and is accordingly unable to provide quantification of distance traveled, velocities or other time-vector movement information, i.e. physics-based information.

Accordingly, it would be desirable to provide an assessment system in an environment representative of actual conditions for the assessment of relevant movement skills that enable the player to view changes in his actual physical position in real-time, spatially correct, constantly changing interactive relationship with a challenge or task.

SUMMARY OF THE INVENTION

The present invention overcomes the limitations of the aforementioned approaches by providing an assessment system wherein the player can execute movement paths without a confining field, i.e. fixed movement locations and while viewing progress toward completing a simulated task in a spatially correct relationship with the virtual objective being sought and have physics-based output information for undertakings.

The assessment system of the present invention provides an accurate measurement of movement and agility skills such that the results can be reported in absolute vectored and scalar units related to time and distance in a sport-specific simulation. Herein, the player is not required to move between fixed ground locations. Rather the player moves to intercept or avoid an object based on visual observations of his real-time constantly changing spatial relationship with the computer-generated object.

The present invention also provides a movement skills assessment system operable without a confining field that tracks the player's position continuously in real-time and not merely between a starting and finishing position. The system includes a wireless position tracker coupled to a personal computer. The computer is coupled to a viewing monitor that displays a computer generated virtual space in 4 dimension space-time with a player icon representing the instantaneous position of the player in scaled translation to the position of the player in a defined physical space where the activity is undertaken. Interactive software displays a protagonist, defined as a moving or stationary object or entity, the task of the player being to intercept or avoid, collide or elude, the protagonist by movement along a path selected by the player, not a path mandated by hardware. The software defines and controls an interactive task and upon completion assesses the ability of the player to complete the task based on distance traveled and elapsed time in the defined physical space. As the movement sequence continues, velocity vectors are measured for each movement segment and processed to compare velocity related information in all directions as well as measurement of elapsed times or composite speeds. The system has applications in sports, commercial fitness and medical rehabilitation wherein output and documentation of vectored, physics-based information is desired.

BRIEF DESCRIPTION OF THE DRAWINGS

The above and other objects, advantages and features of the present invention will become apparent from the following description taken in conjunction with the accompanying draws in which.

DESCRIPTION OF THE PREFERRED EMBODIMENTS

Figure 1:
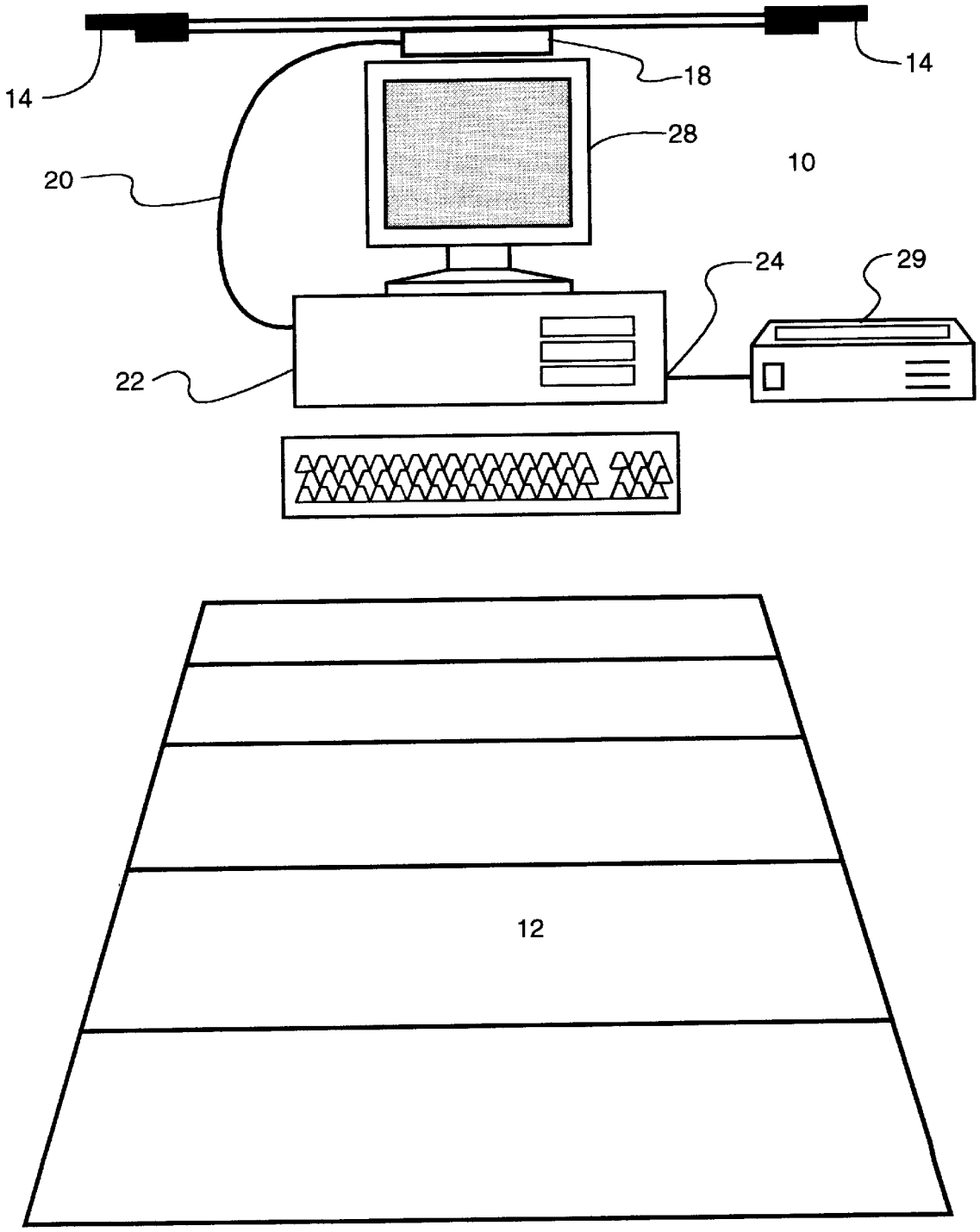
FIG. 1 is a schematic view of a testing and training system in accordance with the invention.

Referring to the drawing for the purposes of describing the preferred embodiments, there is shown in FIG. 1 an interactive, virtual reality testing and training system 10 for assessing movement and agility skills without a confining field. The system 10 comprises a three dimensionally defined physical space 12 in which the player moves, a pair of laterally spaced wireless optical sensors 14, 16 coupled to a processor 18 which comprises the wireless position tracking system. The processor 18 provides a signal along line 20 via the serial port to a personal computer 22 that, under the control of associated software 24, provides a signal to a large screen video monitor 28. The computer 22 is operatively connected to a printer 29, such as a Hewlett Packard Desk Jet 540, for outputting data related to testing and training sessions.

Figure 2:
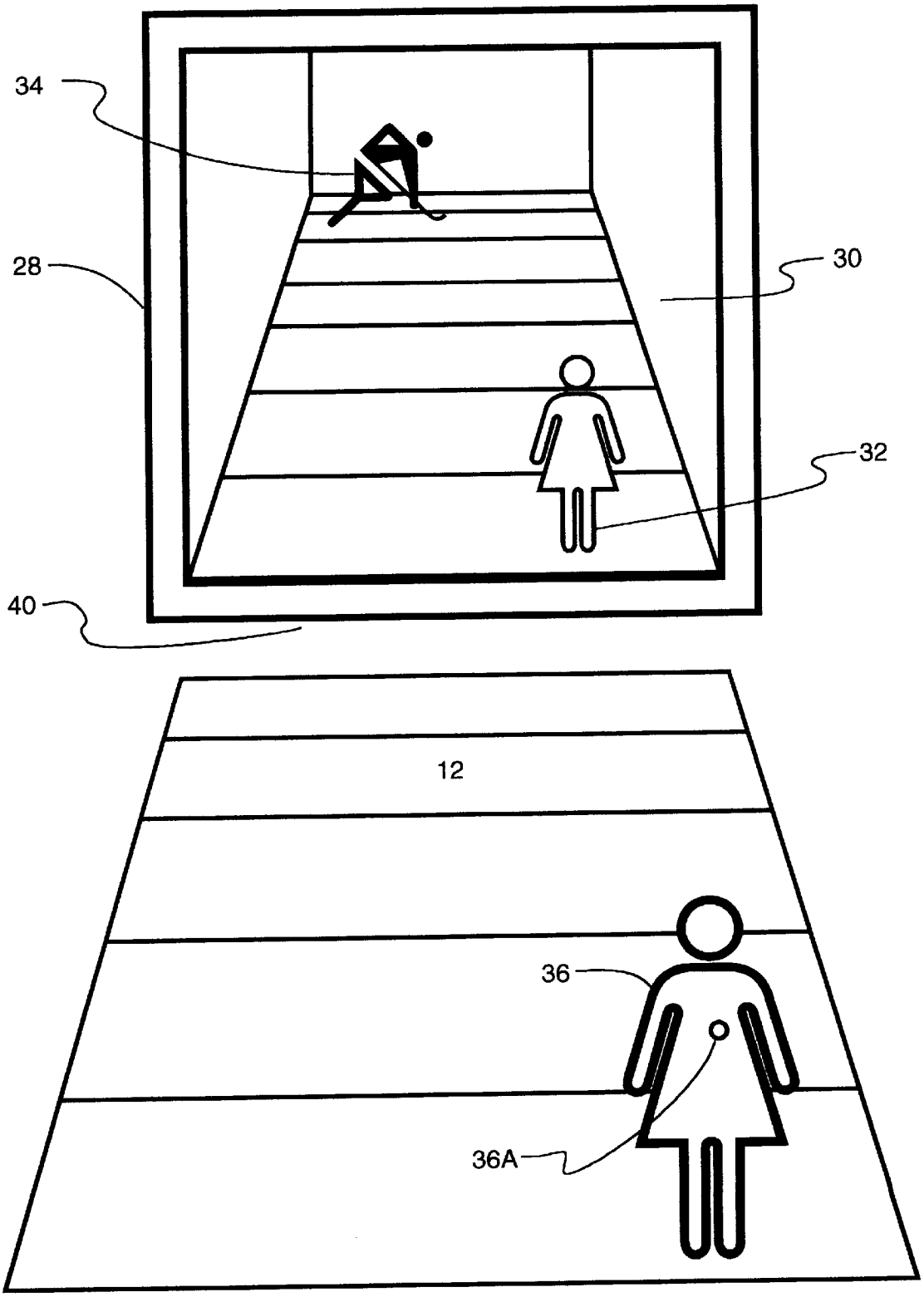
FIG. 2 is representative monitor display.

Referring additionally to FIG. 2, the monitor 28 displays a computer generated, defined virtual space 30 which is a scaled translation of the defined physical space 12. The position of the player in the physical space 12 is represented and correctly referenced in the virtual space 30 by a player icon 32 and interacts with a protagonist icon 34 in the performance of varying tasks or games to be described below.

The system 10 assesses and quantifies agility and movement skills by continuously tracking the player in the defined physical space 12 through continuous measurement of Cartesian coordinate position. By scaling translation to the virtual space 30, the player icon 32 is represented in a spatially correct position and can interact with the protagonist icon 34 such that movement related to actual distance and time required by the player 36 to travel in the physical space 12 can be quantified.

The defined physical space 12 may be any available area, indoors or outdoors of sufficient size to allow the player to undertake the movements for assessing and quantifying distance and time measurements relevant to the player's conditioning, sport and ability. A typical physical space 12 may be an indoor facility such as a basketball or handball court where about a 20 foot by 20 foot area with about a 10 foot ceiling clearance can be dedicated for the training and testing. Inasmuch as the system is portable, the system may be transported to multiple sites for specific purposes. For relevant testing of sports skills on outdoor surfaces, such as football or baseball, where the player is most relevantly assessed under actual playing conditions, i.e. on a grass surface and in athletic gear, the system may be transported to the actual playing field for use.

The optical sensors 14, 16 and processor 18 may take the form of commercially available tracking systems. Preferably the system 10 uses an optical sensing system available as a modification of the DynaSight system from Origin Instruments of Grand Prairie, Tex. Such a system uses a pair of optical sensors, i.e. trackers, mounted about 30 inches apart on a support mast centered laterally with respect to the defined physical space 12 at a distance sufficiently outside the front boundary 40 to allow the sensors 14, 16 to track movement in the desired physical space. The processor 18 communicates position information to an application program in a host computer through a serial port. The host computer is provided with a driver program available from Origin which interfaces the DynaSight system with the application program. The sensors, operating in the near infrared frequency range, interact with passive or active reflector(s) worn by the player. The sensors report target positions in three dimensions relative to a fiducial mark midway between the sensors. The fiducial mark is the origin of the default coordinate system.

Another suitable system is the MacReflex Motion Measurement System from Qualisys. Any such system should provide an accurate determination of the players location in at least two coordinates and preferably three.

In the described embodiment, the player icon 32 is displayed on the monitor 28 in the corresponding width, lateral x axis, height, y axis and depth, or fore-aft z axis and over time t, to create a 4 dimensional space-time virtual world. For tasks involving vertical movement, tracking height, y axis, is required. The system 10 determines the coordinates of the player 36 in the defined physical space 12 in essentially real time and updates current position without any perceived lag between actual change and displayed change in location in the virtual space 30, preferably at a sampling rate of about 20 to 100 Hz.

The monitor 28 should be sufficiently large to enable the player to view clearly virtual space 30. The virtual space 30 is a spatially correct representation of the physical space as generated by the computer 22. For a 20 foot by 20 foot working field, a 27 inch diagonal screen or larger allows the player to perceptively relate to the correlation between the physical and virtual spaces. An acceptable monitor is a Mitsubishi 27" Multiscan Monitor.

The computer 22 receives the signal for coordinates of the player's location in the physical space 12 from the detector 18 and transmits a signal to the monitor 28 for displaying the player icon in scaled relationship in the virtual space 30. An acceptable computer is a Compaq Pentium PC. In other words, the player icon 32 is always positioned in the computer-generated virtual space 30 at the x, y, z coordinates corresponding to the player's actual location in the physical space 12. As the player 36 changes location within the physical space 12, the players icon is repositioned accordingly in the virtual space 30.

To create tasks that induce the player 36 to undertake certain movements, a protagonist icon 34 is displayed in the computer-generated virtual space 30 by the computer software 24. The protagonist icon 34 serves to induce, prompt and lead the player 36 through various tasks, such as testing and training protocols in an interactive game-like format that allows the assessment and quantification of movement and agility skills related to actual distance traveled and elapsed time in the physical space 12 to provide physics-based vectored and scalar information.

The protagonist icon 34 is interactive with the player 36 in that the task is completed when the player icon 32 and the protagonist icon 34 occupy the same location, i.e. interception, or attain predetermined separation, i.e. evasion. As used herein the protagonist icon is the graphic representation with which the player interacts, and defines the objective of the task. Other collision-based icons, such as obstacles, barriers, walls and the like may embellish the task, but are generally secondary to the objective being defined by the protagonist.

The protagonist icon 34 may have varying attributes. For example, the protagonist icon may be dynamic, rather than stationary, in that its location changes with time under the control of the software thereby requiring the player to determine an ever changing interception or evasion path to complete the task.

Further, the protagonist icon can be intelligent, programmed to be aware of the player's position in the computer-generated virtual space 30 and to intercept or evade according to the objectives of the task. Such intelligent protagonist icons are capable of making course correction changes in response to changes in the position of the player icon 32 in much the same manner as conventional video games wherein the targets are responsive to the icon under the player's control, the difference being that the player's icon does not correspond the player's actual position in a defined physical space.

The foregoing provides a system for assessing movement skills and agility skills. Movement skills are generally characterized in terms of the shortest time to achieve the distance objective. They can be further characterized by direction of movement with feedback, quantification and assessment being provided in absolute units, i.e. distance/time unit, or as a game score indicative of the player's movement capabilities related to physics-based information including speed, velocity, acceleration, deceleration and displacement. Agility is generally characterized as the ability to quickly and efficiently change body position and direction while undertaking specific movement patterns. The results also are reported in absolute units, with success determined by the elapsed time to complete the task.

Figure 6:
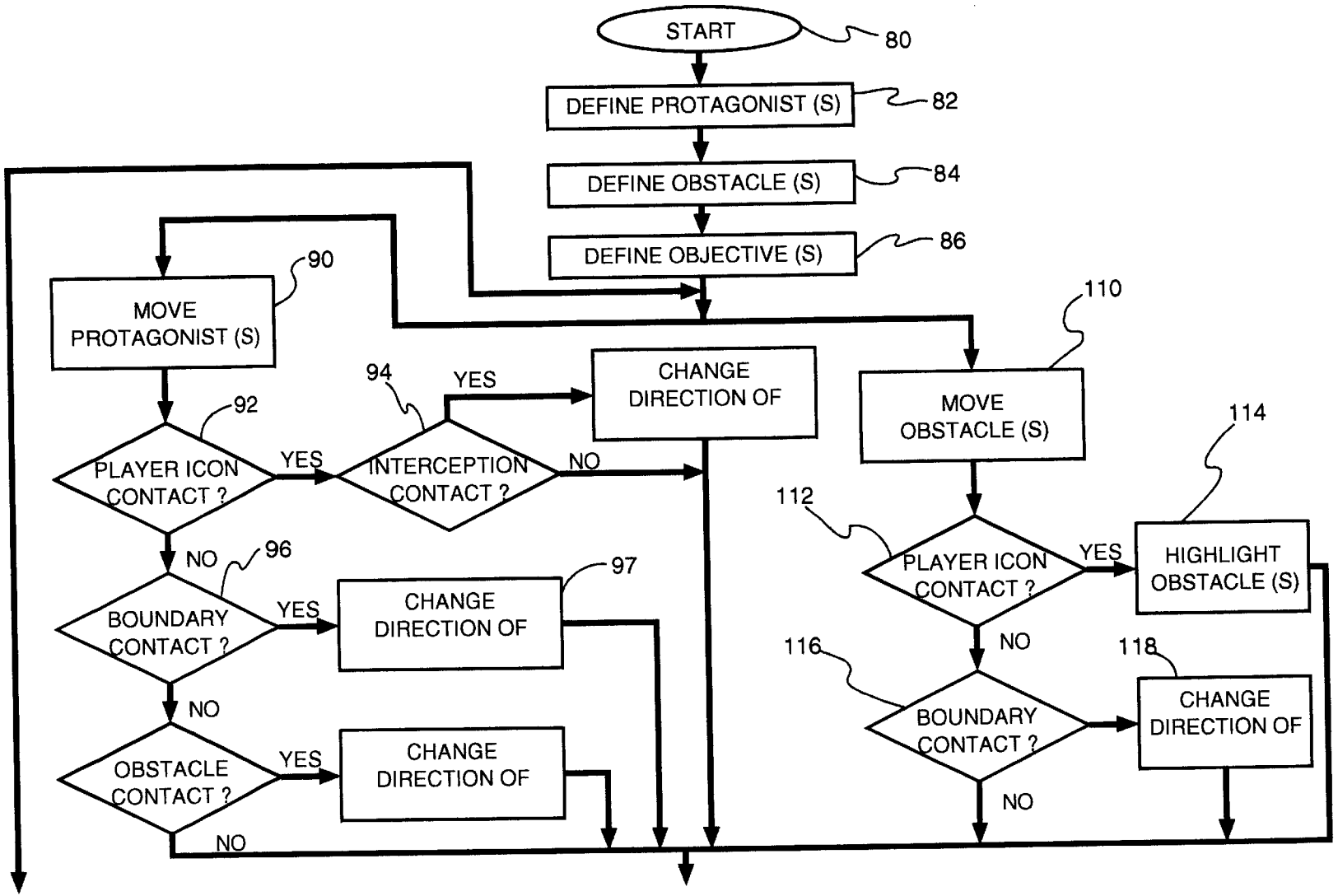
FIGS. 6 and 7 is a software flow chart of a representative task for the system.
Figure 7:
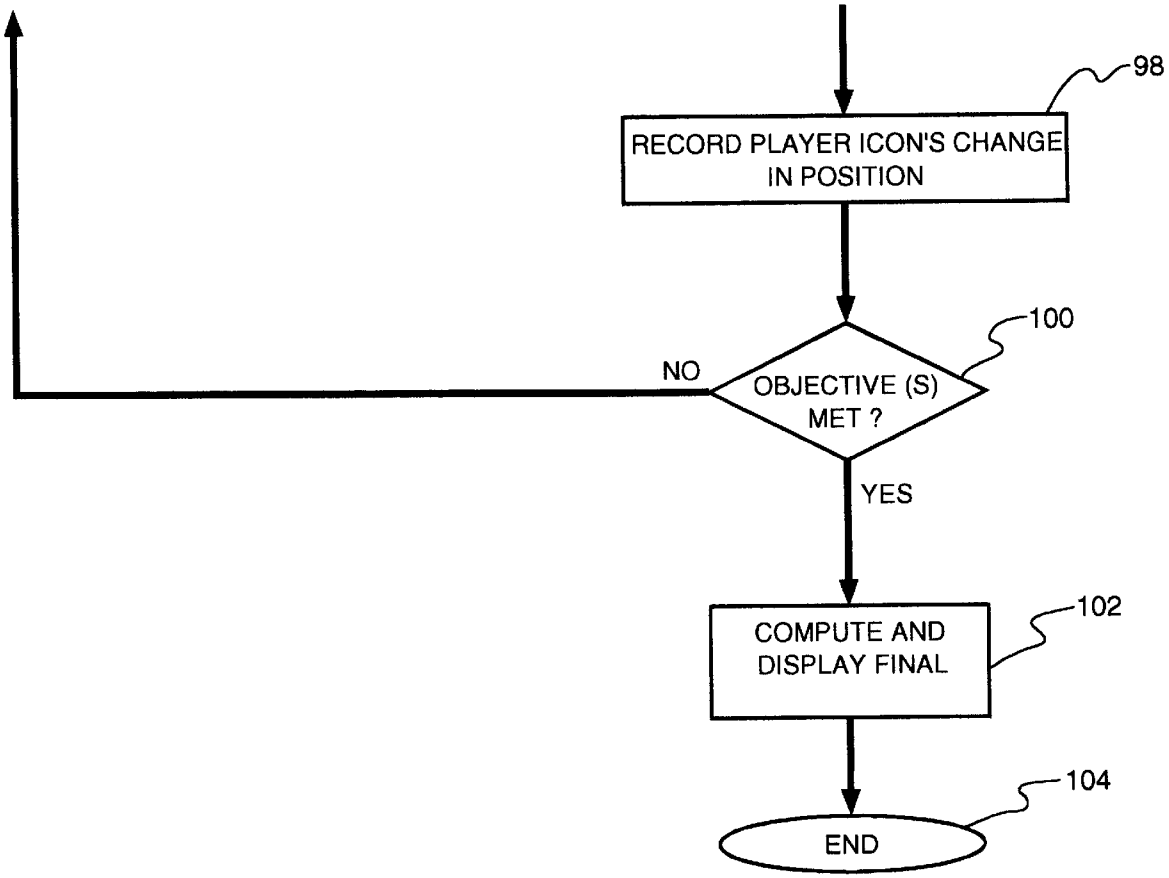

The software flow chart for the foregoing tasks is shown in FIGS. 6 and 7. At the start 80 of the assessment, the player is prompted to Define Protagonists 82. The player may select the intelligence level, number, speed and size of the protagonists to reside in the selected routine. Thereafter the player is prompted to Define Obstacles 84, i.e. static vs. dynamic, number, speed, size and shape. The player is then prompted to Define objectives 86, i.e. avoidance or interception, scoring parameters, and goals, to complete the setup routine.

To start the task routine, the player is prompted to a starting position for the task and upon reaching this position, the protagonist(s) and the obstacle(s) for the task are generated on the display. The protagonist moves on the display, 90, in a trajectory dependent on the setup definition. For an interception routine, the player moves in a path which the player determines will result in the earliest interception point with the protagonist in accordance with the player's ability. During player movement, the player icon is generated, and continually updated, in scaled translation in the virtual space to the player's instantaneous position in the defined physical space. Movement continues until player contact, 92, and interception, 94, or until the protagonist contacts a boundary of the virtual space corresponding to the boundary of the defined physical space, 96. In the former case, if interception has occurred, a new protagonist appears on a new trajectory, 97. The player icon's position is recorded, 98, the velocity vectors calculated and recorded, and a score or assessment noted on the display. The system then determines if the task objectives have been met, 100, and for a single task, the final score is computed and displayed, 102, as well as information related to time and distance traveled in completing the task, and the session ends, 104.

In the event, the player does not intercept the protagonist icon prior to the later contacting a virtual space boundary corresponding to the boundary on the defined physical space, the direction of the protagonist is changed dependent on the setup definition, and the pursuit of the protagonist by the player continues as set forth above.

Concurrently with the player pursuit, in the event that obstacles have been selected in the setup definition, the same are displayed, 110, and the player must undertake a movement path to avoid these obstacles. For a single segment task, if the player contacts the obstacle, 112, the obstacle is highlighted, 114, and the routine is completed and scored as described above. In the event a moving obstacle was selected in the setup definition, if the obstacle strikes a boundary, 116, the obstacle's direction is changed, 118, and the task continues.

For a multiple segment task, if the obstacle is contacted, the protagonist's direction changes and the movements continue. Similarly, upon interception for a multiple segment task, a new protagonist trajectory is initiated and the obstacles also may be reoriented. The routine then continues until the objectives of the task have been met and the session completed.

The tasks are structured to require the player to move forward, backward, left and right, and optionally vertically. The player's movement is quantified as to distance and direction dependent on the sampling rate and the update rate of the system. For each sampling period, the change in position is calculated. At the end of the session, these samples are totaled and displayed for the various movement vectors.

For an avoidance task wherein the objective of the session is to avoid a protagonist seeking to intercept the player, the aforementioned is appropriately altered. Thus if the player is intercepted by the protagonist, the session ends for a single segment task and the time and distance related information is calculated and displayed. For multiple segment tasks, the protagonist trajectory has a new origin and the session continues for the defined task until completed or terminated.

Figure 3:
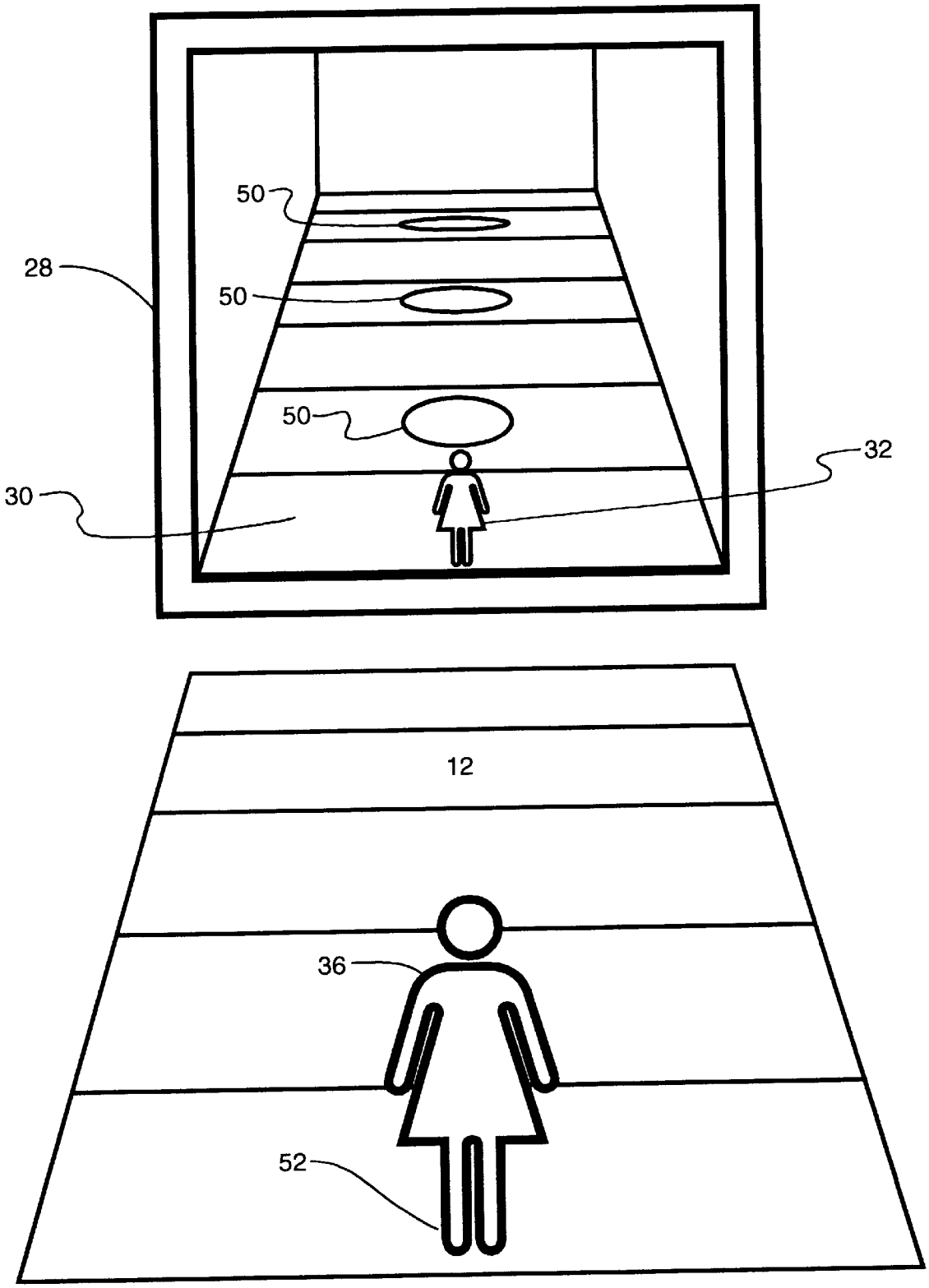
FIG. 3 is a graphical representation of simulated movement skills protocol for the system of FIG. 1.

An example of a functional movement skills test is illustrated in FIG. 3 by reference to a standard three hop test. Therein the player 36 or patient stands on one leg and performs three consecutive hops as far as possible and lands on the same foot. In this instance the player icon 32 is displayed at the center of the rear portion of the computer-generated virtual space 30 a position in scaled translation to the position of the player 36 in the defined physical space 12. Three hoops 50, protagonist icons, appear on the display indicating the sequence of hops the player should execute. The spacing of the hoops may be arbitrarily spaced, or may be intelligent, based on standard percentile data for such tests, or on the best or average past performances of the player. In one embodiment, the player 36 is prompted to the starting position 52. When the player reaches such position, the three hoops 50 appear representing the 50th percentile hop distances for the player's classification and after a slight delay the first hoop is highlighted indicating the start of the test. The player then executes the first hop with the player's movement toward the first hoop being depicted in essentially real-time on the display. When the player lands after completion of the first hop, this position is noted and stored on the display until completion of the test and the second hoop and third hoop are sequentially highlighted as set forth above. At the end of the three hops, the player's distances will be displayed with reference to normative data.

Figure 4:
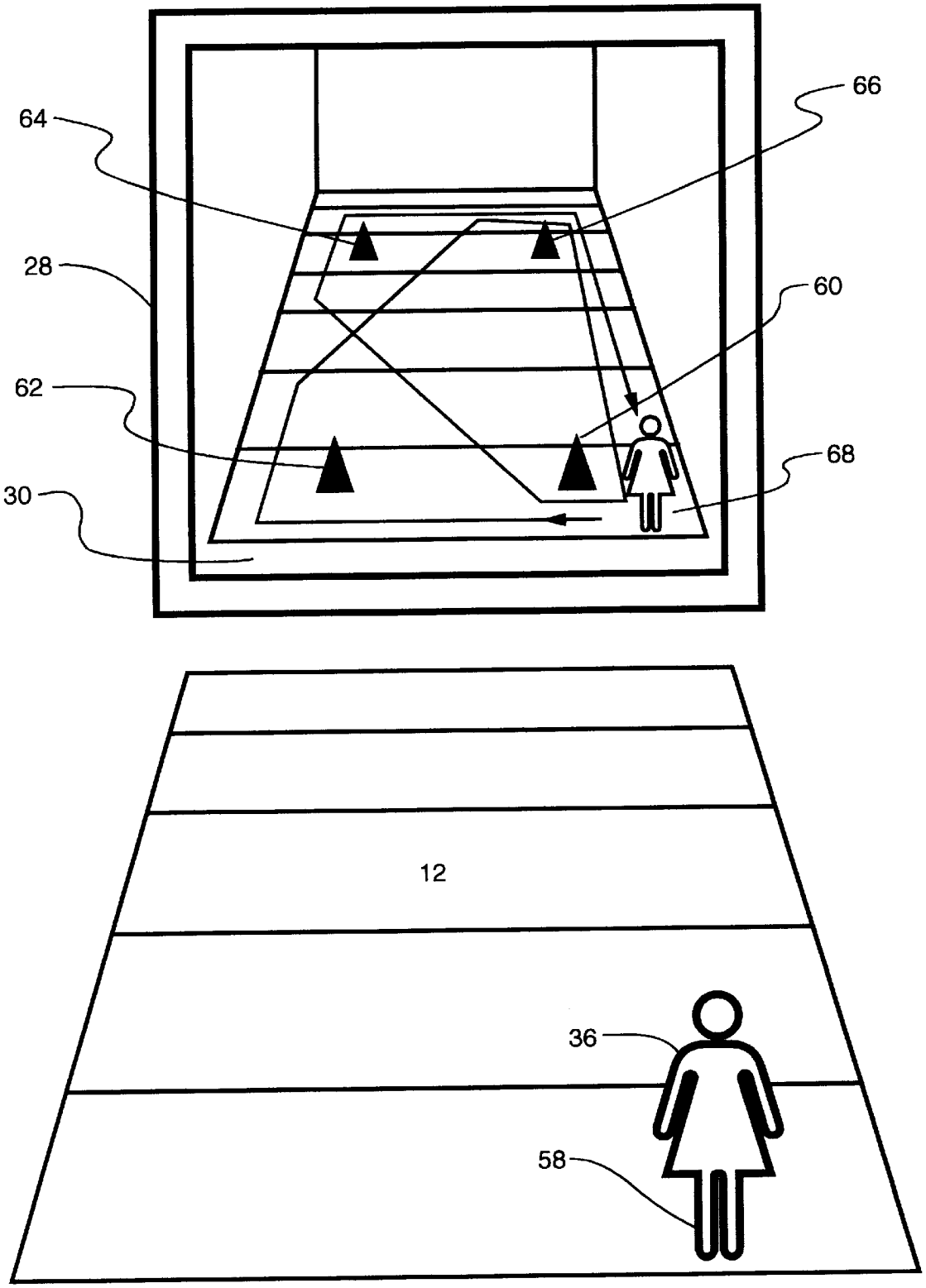
FIG. 4 is a graphical representation of a simulated agility skills protocol for the system of FIG. 1.

A test for agility assessment is illustrated in FIG. 4 for a SEMO Agility Test wherein the generated virtual space 30 is generally within the confines of a basketball free throw lane. Four cones 60, 62, 64, 66 are the protagonist icons. As in the movement skills test above, the player 36 is prompted to a starting position 68 at the lower right corner. When the player 36 reaches the starting position in the defined physical space the left lower cone 62 is highlighted and the player side steps leftward thereto while facing the display. After clearing the vicinity of cone 62, the fourth cone 66, diagonally across at the front of the virtual space 30 is highlighted and the player backpedals toward and circles around cone 66. Thereafter the player sprints toward the starting cone 60 and circles the same and then backpedals to a highlighted third virtual cone 64. After circling the cone 64, cone 66 is highlighted and the player sprints toward and circles the cone 66 and then side steps to the starting position 68 to complete the test. In the conventional test, the elapsed time from start to finish is used as the test score. With the present invention, however, each leg of the test can be individually reported, as well as forward, backward and side to side movement capabilities.

As will be apparent from the above embodiment, the system provides a unique measurement of the play's visual observation and assesses skills in a sport simulation wherein the player is required to intercept or avoid the protagonist based on visual observation of the constantly changing spatial relationship with the protagonist. Additionally, excursions in the Y-plane can be quantified during movement as a measure of an optimal stance of the player.

Figure 5:
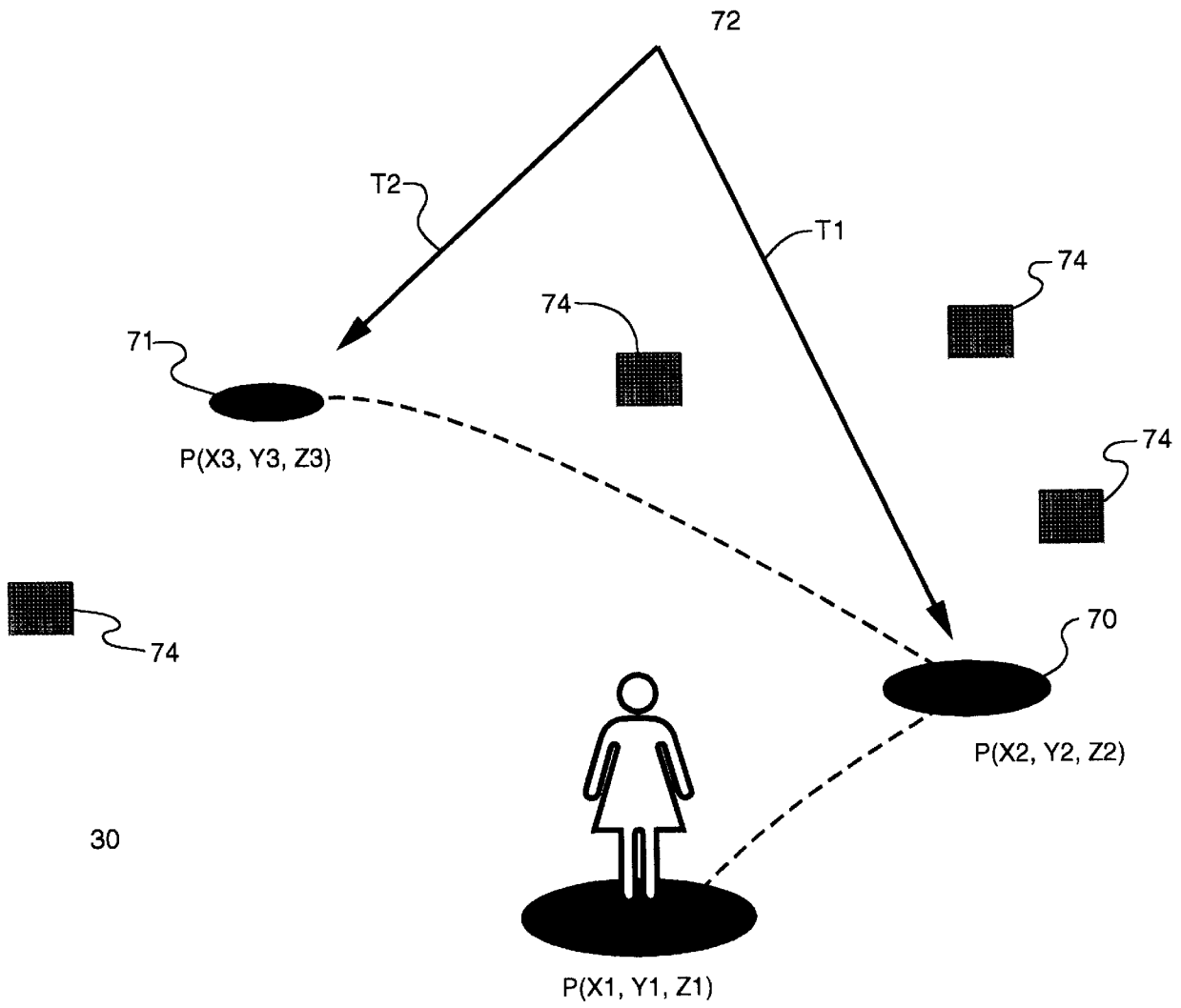
FIG. 5 is a graphical representation of a simulated task for the system.

The foregoing and other capabilities of the system are further illustrated by reference to FIG. 5. Therein, the task is to intercept targets 70, 71 emanating from a source 72 and traveling in a straight line trajectories T1, T2. The generated virtual space 30 displays a plurality of obstacles 74 which the player must avoid in establishing an interception path with the target 70. The player assumes in the defined physical space a position which is represented on the generated virtual space as position P(x1, y1, z1)in accurately scaled translation therewith. As the target 70 proceeds along trajectory T1, the player moves along a personally determined path in the physical space which is indicated by the dashed lines in the virtual space to achieve an interception site coincident with the instantaneous coordinates of the target 70, signaling a successful completion of the first task. This achievement prompts the second target 71 to emanate from the source along trajectory T2. In order to achieve an intercept position for this task, the player is required to select a movement path which will avoid contact or collision with virtual obstacle 74. Thus, within the capabilities of the player, a path shown by the dashed lines is executed in the defined physical space and continually updated and displayed in the virtual space as the player intercepts the protagonist target at position P(x3,y3,z3) signaling completion of the second task. The assessment continues in accordance with the parameters selected for the session, at the end of which the player receives feedback indicative of success, ie. scores or critical assessment based on the distance, elapsed time for various vectors of movement.

Another protocol is a back and forth hop test. Therein, the task is to hop back and forth on one leg over a virtual barrier displayed in the computer-generated virtual space. The relevant information upon completion of the session would be the amplitude measured on each hop which indicates obtaining a height sufficient to clear the virtual barrier. Additionally, the magnitude of limb oscillations experienced upon landing could be assessed. In this regard, the protocol may only measure the vertical distance achieved in a single or multiple vertical jump.

The aforementioned system accurately, and in essentially real-time, measures the absolute three dimensional displacements over time of the body's center of gravity when the sensor marker is appropriately located on the player's mass center. Measuring absolute displacements in the vertical plane as well as the horizontal plane enables assessment of both movement skills and movement efficiency.

In many sports, it is considered desirable for the player to maintain a consistent elevation of his center of gravity above the playing surface. Observation of excursions of the player's body center of gravity in the fore-aft (Z) during execution of tests requiring solely lateral movements (X) would be considered inefficient. For example, displacements in the player's Y plane during horizontal movements that exceed certain preestablished parameters could be indicative of movement inefficiencies.

In a further protocol using this information, the protagonist icon functions as an aerobics instructor directing the player through a series of aerobic routines. The system can also serve as an objective physiological indicator of physical activity or work rate during free body movement in essentially real time. Such information provides three benefits: 1. enables interactive, computer modulation of the workout session by providing custom movement cues in response to the player's current physical activity; 2. represents a valid and unique criteria to progress the player in his training program; and 3. provides immediate, objective feedback during training for motivation, safety and optimized training. Such immediate, objective feedback of performance is currently missing in all aerobics programs, particularly unsupervised home programs.

Various modifications of the above described embodiments will be apparent to those skilled in the art. Accordingly, the scope of the invention is defined only by the accompanying claims.

What is claimed:

1. A testing and training system for assessing the ability of a player to complete a task, comprising:

providing a defined physical space within which said player moves to undertake the task;

means for determining a plurality of positions of said player within said defined physical space based on three coordinates;

display means operatively coupled to said tracking means for displaying in a virtual space a player icon representing the instantaneous position of said player therein in scaled translation to the position of said player in said defined physical space;

means operatively coupled to said display means for depicting in said virtual space a protagonist;

means for assigning a time parameter to each of said determined positions of said player;

means for assessing the ability of said player in completing said task based on quantities of velocities and/or acceleration; and means for defining an interactive task between a position of the player and a position of the protagonist icon in said virtual space.

2. A testing and training system comprising:

means for measuring in essentially real time a plurality of three dimensional displacements of a user's center of gravity as said user responds to interactive protocols;

means for calculating said user's movement velocities and/or accelerations during performance of said protocols;

means for determining said user's most efficient dynamic posture; and means for providing numerical and/or graphical results of said measured displacements, calculated velocities and accelerations, and determined posture.

3. A system as in claim 2 wherein said interactive protocols include sport specific protocols.

4. A system as in claim 1, further comprising:

means for calibrating said system for a dynamic posture that a user wishes to utilize;

means for providing varying interactive movement challenges over distances and directions;

means for providing real-time feedback of a measurement of compliance with the desired dynamic posture during performance of the protocols, and means for providing results of the user's performance.

5. A system as in claim 1, further comprising:

means for tracking at sufficient sampling rate the user's movement in three-degrees-of-freedom during his performance of protocols, including unplanned movements over various vector distances;

means for calculating in essentially real-time the user's movement accelerations and decelerations;

means for categorizing each movement leg to a particular vector; and means for displaying feedback of bilateral performance.

6. A testing and training system comprising:

means for tracking a user's position within a physical space in three dimensions;

display means operatively linked to said tracking means for indicating the user's position within said physical space in essentially real time;

means for assessing the user's performance in executing said physical activity;

means for defining a physical activity for said user operatively connected to said display means; and means for measuring in real time three dimensional displacements of said user in said physical space.

7. A system as in claim 6 further comprising:

means for calculating said user's movement velocities and/or accelerations during performance of said protocols;

means for determining a user's most efficient dynamic posture; and means for providing numerical and graphical results of said measured displacements, calculated velocities and accelerations, and determined posture.

8. A system as in claim 6, further comprising:

means for calibrating said system for a dynamic posture that the user wishes to utilize;

means for providing interactive movement challenges over varying distances and directions;

means for providing real-time feedback of a measurement of compliance with the desired dynamic posture during performance of the protocols, and means for providing results of the user's performance.

9. A system as in claim 6 further comprising:

means for tracking at sufficient sampling rate the user's movement in three-degrees-of-freedom during his performance of protocols, including unplanned movements over various vector distances;

means for calculating in essentially real-time the user's movement accelerations and decelerations;

means for categorizing each movement leg to a particular vector; and means for displaying feedback of bilateral performance.

* * * * *